United States Patent [19]

Walling et al.

[11] Patent Number: 4,710,594

[45] Date of Patent: Dec. 1, 1987

[54] TELECOMMUNICATIONS CABLE

[75] Inventors: Jorg-Hein Walling, Beaconsfield; Jacques Cornibert, Ile Des Seours; Gordon D. Baxter, Kingston; Marie-Francoise Bottin, Lachine; Oleg Axiuk, Pincourt; Phillip J. Reed, Dorval, all of Canada

[73] Assignee: Northern Telecom Limited, Montreal, Canada

[21] Appl. No.: 877,065

[22] Filed: Jun. 23, 1986

[51] Int. Cl.[4] ..... H01B 7/00

[52] U.S. Cl. ..... 174/120 SR; 156/51; 174/121 R; 174/121 SR; 174/122 G; 264/174

[58] Field of Search ..... 174/120 SR, 121 R, 121 SR, 174/122 G, 124 GC, 122 R, 70 R, 113 R, 115; 264/174; 156/48, 51, 53

[56] References Cited

U.S. PATENT DOCUMENTS

| | | | |
|---|---|---|---|
| 3,728,474 | 4/1973 | Arnaudin, Jr. | 174/115 |
| 3,830,953 | 8/1974 | Wood et al. | 174/23 C |
| 3,849,354 | 11/1974 | Strecker et al. | 156/48 X |
| 3,879,518 | 4/1975 | Ney et al. | 174/113 R X |
| 3,983,313 | 9/1976 | Ney et al. | 174/122 G X |
| 4,082,423 | 4/1978 | Glista et al. | 174/70 R X |
| 4,151,237 | 4/1979 | Ney | 174/122 G X |
| 4,469,538 | 9/1984 | Wade et al. | 174/115 X |

FOREIGN PATENT DOCUMENTS

| | | | |
|---|---|---|---|
| 2454608 | 5/1976 | Fed. Rep. of Germany | 174/107 |

OTHER PUBLICATIONS

Panuska, A. J. et al.; Reinforced Insulation for Conductor; Technical Digest; No. 56 (Oct. 79).

*Primary Examiner*—Morris H. Nimmo
*Attorney, Agent, or Firm*—R. J. Austin

[57] ABSTRACT

A telecommunications cable having no metal sheath, but having a plurality of equally pre-tensioned and inextensible tensile members embedded in the cable jacket. These members are spaced apart around the core and extend longitudinally of the cable to apply an axially compressive force upon the jacket. The members may be glass fibers and each member is preferably a roving of fibers. The filaments may be coated with a material which sticks them to the jacket and the core may be filled with a moisture blocking material.

16 Claims, 5 Drawing Figures

TELECOMMUNICATIONS CABLE

This invention relates to a telecommunications cable.

Some telecommunications cables have a core comprising one or more pairs of individually insulated conductors covered by a plastic jacket and are intended to be used to connect a subscriber's line from a distribution terminal to the subscriber's premises. Such cables are normally referred to as "service wire". "Service wire" may be buried or, if installed aerially, is called "drop wire" and is strung between supports such as from a distribution terminal at a pole to a line protector on the subscriber's premises.

"Drop wire" or other aerial cable needs to be clamped around the cable jacket at support positions. The weight of the cable between support positions creates tensile stresses and unless axially extending tensile members are present in the cable, then the cable will stretch significantly so as to hang in a catenary with a progressively increasing sag. The magnitude of the stresses is increased by wind pressure and ice formation, the latter adding to the weight of the cable.

In early "drop wire" cable structures, the conductors acting as transmission elements and also as the tensile members, were formed from steel wire coated with copper and the jacket was bonded closely to the copper to transmit the tensile forces from the cable support clamps to the conductors. In later structures, conductors of "drop wire" cables have been formed solely from copper. To prevent the tensile stresses acting unduly on the copper conductors, axially extending tensile members are embedded in the jackets of such cables so that the stresses are taken directly along the members from one clamp to another. A problem with such a construction is, however, that there is a significant degree of extensibility of the cables after installation. According to one aspect of the present invention there is provided a telecommunications cable devoid of a metal sheath and which comprises a core including a plurality of individually insulated conductors, a surrounding jacket and a plurality of substantially equally pre-tensioned and substantially inextensible elongate tensile members embedded in the jacket and extending longitudinally of the cable to place an axially compressive force upon the jacket, the elongate members spaced apart circumferentially around the core.

The pre-tensioned members will immediately be further stressed by any axial load placed upon the cable and will thus immediately resist cable extension. On the other hand, in a cable having tensile members which are not pre-tensioned, upon the application of an axial load placed upon the cable, the tensile members will not immediately resist extension of the cable because the initial load will merely straighten out the members themselves. Initial extension of the cable will thus take place without resistance offered by the tensile members and such extension will be in excess of that of the cable of the present invention.

The material of the tensile members and the degree of pre-tensioning thereof is such that the recoverable elastic elongation of the members must not be so great as to cause buckling of the cable.

In the above construction which is applicable for aerial cable, while the tensile members may be of any suitable material and structure they are preferably fibers which conveniently may be glass fibers. Each of the members may be twisted strands in which case the number of twists per unit length should be minimized to reduce the initial elongation of the strands under load conditions. It is envisaged that in a twisted structure, the twist should be below four turns per inch length. In the preferred arrangement, the tensile members are each formed from a roving of fibers having no twist or a negligible twist such as would be provided during unspooling of the roving when feeding it for incorporation into the cable. As each fiber of the roving extends longitudinally of the cable, then to allow for sufficient bending action of the cable structure with insignificant distortion, the tensile members should not lie at a distance greater than approximately 0.325 cm from the cable axis, e.g. the members may all be disposed upon a pitch circle with a maximum diameter of 0.65 cm.

According to another aspect of the invention, there is provided a telecommunications cable devoid of a metal sheath and comprising a core including a plurality of individually insulated conductors, a surrounding jacket and a plurality of substantially equally pre-tensioned and substantially inextensible elongate tensile members embedded in the jacket and extending longitudinally of the cable to place an axially compressive force upon the jacket, the elongate members spaced apart circumferentially around the core, each of the tensile members having a coating of a material which is compatible with the jacket and the tensile members being adhered to the jacket by means of the coating.

The coating increases the ultimate tensile strength of the tensile members and also causes adhesion of the tensile members to the jacket. Provision of an adhesive at the interface between tensile members and jacket also seals any moisture leakage path along the cable at the interfacial region. There are various suitable coating materials. These include polyethyleneimine, polyvinyl chloride and polyurethane for adherence to a polyvinyl chloride jacket.

In a further preferred arrangement, the cable is also suitable for buried application. In this structure, the cable core is filled with a moisture blocking material to resist penetration of moisture along the cable.

Any suitable moisture blocking material will suffice and, in general, any desired material for the jacket may be used and without a core wrap if none is required. However, care needs to be taken with the use of certain moisture blocking materials and jacketing materials in the same cable. For instance, where the moisture blocking material is a grease and the jacket is to be formed from a polyvinyl chloride based compound, contact with the grease by the compound during jacket extrusion tends to affect the compound deleteriously and the tensile members may become displaced in the cable. In a cable, therefore, where these two materials are to be used, a barrier such as a core wrap is required around the grease filled core to prevent its contact with the extrudate as the jacket is being formed. On the other hand, a polyvinyl chloride based jacket compound may be used with a plastisol as a water blocking medium without need of a core wrap.

It is also to be preferred to have a moisture barrier between the core wrap and the jacket. This is conveniently provided in a practical construction by adhering interfacial regions of the core wrap and the jacket. The core wrap is either pre-coated with an adhesive or surface treated such that the jacket sticks to the core wrap. A suitable surface treatment is that referred to, for instance, as "Corona" surface treatment which is a well known process for surface treating film.

The invention also includes a method of making a telecommunications cable which is devoid of a metal sheath and having a core inclding a plurality of independently insulated conductors, a surrounding jacket and a plurality of substantially inextensible elongate tensile members embedded in the jacket and extending longitudinally of the cable, the method comprising drawing the elongate tensile members and the core in desired respective positions along a passline through a jacket forming station and extruding molten polymeric material around the core and the tensile members to form the jacket while resisting movement of the tensile members in at least one position upstream from the jacket forming station to apply a tensile load to each of the tensile members which is greater than any tensile load applied to the core, and allowing the jacket to cool and harden while retaining a greater tensile load on each of the tensile members than on the core.

The invention further includes a method of making a telecommunications cable devoid of a metal sheath and having a core including a plurality of individually insulated conductors, a surrounding jacket and a plurality of substantially inextensible elongate tensile members embedded in the jacket and extending longitudinally of the cable, the method comprising providing the elongate tensile members with a coating and drawing the coated tensile members and the core, in desired respective positions, along a passline through a jacket forming station and extruding molten polymeric material around the core and the tensile members to form a jacket adhering to the coating while resisting movement of the tensile members in at least one position upstream from the jacket forming station to apply a tensile load to each of the members which is greater than any tensile load applied to the core, and allowing the jacket to cool and harden while retaining a greater tensile load on each of the tensile members than on the core.

Embodiments of the invention will now be described, by way of example, with reference to the accompanying drawings in which:-

Figure 1:
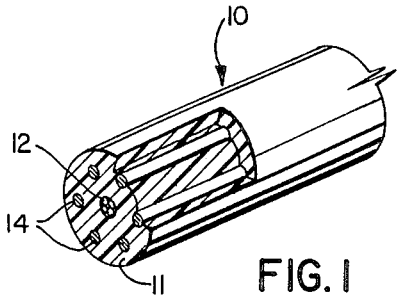
FIG. 1 is an isometric view of a length of a cable according to a first embodiment and partly in cross-section.

In a first embodiment, as shown in FIG. 1, a telecommunications cable 10 is to be used as a "service wire" for connecting a distribution terminal to a line protector on a subscriber's premises. This cable is constructed so that it is suitable either to be strung between supports from a pole carrying the distribution terminal to the subscriber's premises or it may be buried.

The cable comprises a core 12 consisting of two pairs of individually insulated conductors. The core is surrounded by a jacket 11 of a polyvinyl chloride based compound within which are embedded eight longitudinally extending tensile members 14, each of which consists of a roving of glass fibers (i.e. a loose assemblage of glass fibers drawn into a single strand with very little twist). Each roving has approximately 735 tex (where a "tex" is a unit for expressing linear density, 735 tex corresponding to 735 grams per kilometer of roving) and consists of at least 1000 to 2000 filaments. The rovings are pre-coated with a suitable adhesion promoting coating such as polyvinyl chloride. The tensile members lie approximately upon a pitch circle having a diameter of approximately 0.65 cms and centered upon the longitudinal axis of the cable.

As each of the tensile members is in the form of a roving, then there is substantial avoidance of twist between the fibers of each member. Any negligible twist which does exist has been provided during the removal of a tensile member from a spool during its incorporation into the cable.

Figure 2:
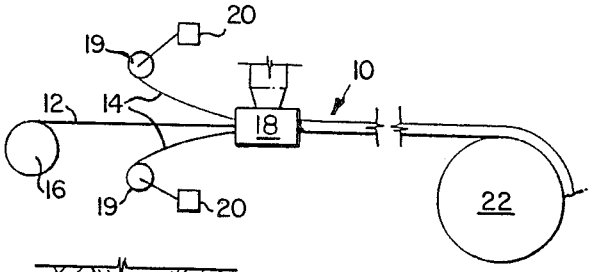
FIG. 2 is a side elevational and diagrammatic view of apparatus for making the cable shown in FIG. 1.

To make the cable, as shown in FIG. 2, the core 12 is drawn from a reel 16 and is fed through a cross-head 18 of an extruder (not shown) which supplies polyvinyl chloride in molten form in well known manner for extruding the jacket around the core to form the cable 10. Simultaneously with the drawing of the core through the cross-head, each of the tensile members 14 is also drawn into the cross-head from spools 19. These spools are provided with a controlled braking system 20, identified diagrammatically in FIG. 2, and the braking system is applied so as to resist the drawing-off operation caused by a capstan 22 at the downstream end of a feedpath for the cable. Thus each of the tensile members 14 is pre-tensioned as it moves towards the cross-head 18 and before incorporation into the cable. This pre-tensioning is greater for each tensile member than any tension which is placed upon the core itself. It has been found that a pre-tensioning load of approximately 2 lbs is suitable for this purpose.

Figure 3:
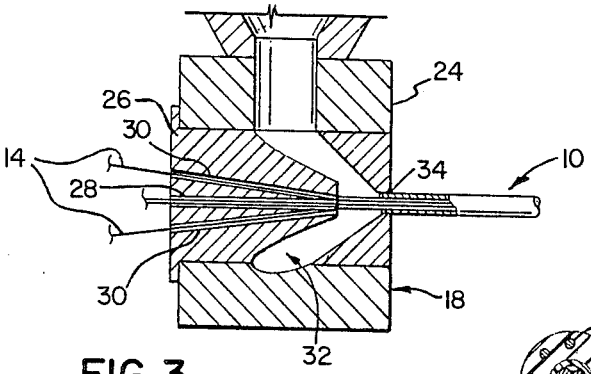
FIG. 3 is a side elevational view, in cross-section, of an extruder cross-head for extruding molten polymeric material onto the core of the cable to provide an extruded jacket.

As shown by FIG. 3, the cross-head 18 is of normal construction in that it has a housing 24 incorporating a core tube 26 which has passages 28 and 30 for controllably guiding the core 12 and the tensile members 14 through the cross-head and into their desired relative positions preparatory to being provided with the jacket. As the core and tensile members move from the core tube, they move into the downstream end of a passage 32 for the molten material in the cross-head as it moves towards the extrusion orifice 34.

The polyvinyl chloride jacket is extruded around the core and the tensile members and, as the finished cable moves downstream from the cross-head, the jacket is cooled and solidifies. During the solidification process, the tension is maintained on each of the tensile members 14 between the reeler 22 and the braking system 20 so that in the finished construction and after release of the tensioning load, the tensile members relax slightly and place the remainder of the cable in compression.

In the finished construction therefore, the tensile members extend longitudinally along the cable with substantially no lateral deviation as would be the case if they were in a relaxed state. In view of this, immediately a tensile load is applied to the cable, e.g. upon being strung between a pole and a subscriber's premises, then the tensile members immediately are subjected to this load and their tension increases to resist any elongation of the cable. As a result, the cable will only extend to the degree that the tensile members themselves will extend under load and this extension is of course minimized, because of the avoidance of slack in the tensile members themselves.

Desirably, the tensile members should satisfy certain desired elongation requirements to ensure minimal elongation of the cable under tensile load. In a test procedure to determine the elongation under load and also the residual elongation after relaxation of the load of the tensile members, samples of potential tensile member material are prepared, these samples being sufficient to provide a measured 10 m length. The samples are suspended vertically from an upper end and an initial downwards load of 20 kg is applied to the other end of the sample to straighten it. A 10 m length is then measured on the sample and the initial load is afterwards increased to a maximum load of 154 kg which is maintained for 1 hr. The extension to the 10 m length is then measured to provide the elongation under maximum load. The maximum load is then reduced to the initial load of 20 kg and the extension to the original 10 m length is again measured to decide the residual elongation in the sample. In the above test, for a material to qualify as suitable for use as the tensile members, it must have a maximum elongation under the 154 kg of 0.9% and a maximum residual elongation, i.e. after reducing the 154 kg to 20 kg, of 0.3%. As can be seen from Table 1, in which the elongation requirements and the dead load and breaking strength requirements are included, the glass fiber roving material used for the tensile members 14 is compared under the above test conditions with a plied yarn material of 870 tex. The plied yarn material has a twist of four turns per inch. A glass fiber roving as used in the embodiment has a negligible twist and has 735 tex. A minimum of 330 tex is considered satisfactory for each tensile member of the invention.

In Table 1, a plied yarn is identified as Sample 1. As can be seen, this sample has an elongation under the 154 kg maximum load which is 1.09% and is higher than the maximum desired. Similarly, the residual elongation after reduction of the 154 kg load to 20 kg load is 0.51% and also is higher than the maximum desired. In comparison with this in Sample 2, each of the tensile members 14 in the embodiment has a maximum elongation under the 154 kg load of 0.79% and a residual elongation under the final 20 kg load of 0.10% which is significantly below the maximum figures.

It has been found that in a preferred arrangement, e.g. according to the first embodiment, ultimate tensile strength is increased when the tensile members are precoated with certain materials. Such materials may also cause adhesion of the fibers to the jacket. Suitable materials for these two purposes include for instance polyvinyl chloride (as in the embodiment), polyurethane or polyethyleneimine. In a modification, Sample 3, no pre-coating material is used for the tensile members. As can be seen with Sample 3, there is a slightly higher elongation and residual elongation than in Sample 2, i.e. 0.8% and 0.18%, but these are still satisfactorily below the maximum requirements. In addition to this, as can be seen from the breaking load in the Table, while Sample 3 has a breaking strength which exceeds the 720 lbs minimum, this breaking strength of 800 lbs is increased significantly in Sample 2. Thus the rovings coated with polyvinyl chloride for adherence to the jacket provide a more desirable construction.

TABLE 1

| | REQUIRED | S1 | S2 | S3 |
|---|---|---|---|---|
| BREAKING STRENGTH (lbs) | 720 (MIN) | 820 | 1020 | 800 |
| DEAD LOAD | SUPPORT 154 kg FOR 7d | pass | pass | pass |
| ELONGATION UNDER MAXIMUM LOAD | 0.9% MAX | 1.09% | 0.79% | 0.8% |

TABLE 1-continued

| | REQUIRED | S1 | S2 | S3 |
|---|---|---|---|---|
| RESIDUAL ELONGATION | 0.3% MAX | 0.51% | 0.1% | 0.18% |

Figure 4:
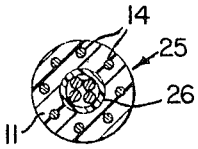
FIG. 4 is a cross-sectional view of a cable according to a second embodiment.

In a second embodiment as shown in FIG. 4, which is a cable 25 suitable for buried locations, and which is otherwise similar to the embodiment shown in FIG. 1, the core is grease filled. The cable is provided with a core wrap 26 of suitable plastics material, e.g. "Mylar" (trademark), the core wrap being surface treated, for instance, by the "Corona" surface treatment process for surface treating film to promote adhesion between the core wrap and the jacket material during extrusion and jacket hardening. This adhesive is compatible with the polyvinyl chloride. In this second embodiment, the grease filled core prevents the movement of the moisture along the core, and the adherence between the PVC jacket and the core wrap provides a moisture proof barrier which also prevents the moisture from moving along the cable between the jacket and core wrap by capillary action.

Figure 5:
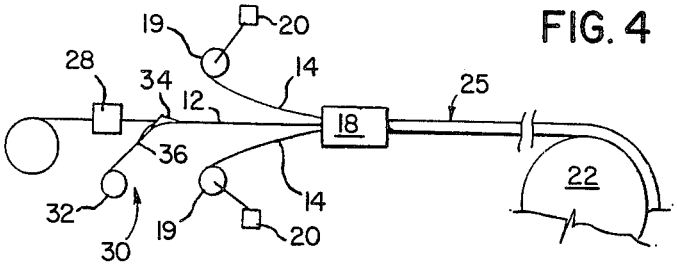
FIG. 5 is a view, similar to FIG. 2 of apparatus for making the cable of FIG. 4.

In the manufacture of cable 25, apparatus, which is otherwise the same as that shown in FIG. 2, has a grease filling chamber 28 and core wrap applying means 30 as shown in FIG. 5. The grease filling chamber 28 is of conventional construction for impregnating cable cores by a pressurized grease system, and is positioned upstream from the cross-head 18. The core 12 passes through the chamber 28 as it approaches the cross-head. The core wrap applying means 30 comprises a reel 32 of core wrap tape and a core wrap forming device 34 of conventional construction and which is positioned between the chamber 28 and cross-head 18. The core wrap tape 36 is fed into the device 34 so as to be wrapped around the grease filled core in conventional manner and form the core wrap 26. The core wrap protects the polyvinyl chloride based compound of the jacket material from the effects of the grease during the extrusion and solidification process.

What is claimed is:

1. A telecommunications cable devoid of a metal sheath and comprising a core including a plurality of individually insulated conductors, a surrounding jacket and a plurality of substantially equally pre-tensioned and substantially inextensible elongate tensile members embedded in the jacket and extending longitudinally of the cable to place an axially compressive force upon the jacket, the elongate members spaced apart circumferentially around the core.

2. A cable according to claim 1 wherein each of the tensile members is formed from glass fiber.

3. A cable according to claim 1 wherein each of the tensile members is formed from tensile fibers in the form of a roving and each of the members is embedded in the jacket at a maximum distance of approximately 0.325 cm from the cable axis.

4. A cable according to claim 3 wherein each roving has at least 330 tex.

5. A cable according to claim 3 wherein the tensile members are disposed substantially on a pitch circle having a maximum diameter of 0.65 cm around the cable axis.

6. A cable according to either of claims 1 and 3 wherein the core has interstices filled with a moisture blocking material.

7. A cable according to claim 6 having a core wrap surrounding the core and lying within the jacket.

8. A cable according to claim 7 wherein the core wrap is adhered to the jacket.

9. A cable according to claim 6 wherein the moisture blocking material is grease and the jacket is made from a polyvinyl chloride based compound.

10. A telecommunications cable devoid of a metal sheath and comprising a core including a plurality of individually insulated conductors, a surrounding jacket and a plurality of substantially equally pre-tensioned and substantially inextensible elongate tensile members embedded in the jacket and extending longitudinally of the cable to place an axially compressive force upon the jacket, the elongate members spaced apart circumferentially around the core, each of the tensile members having a coating of a material which is compatible with the jacket and the tensile members being adhered to the jacket by means of the coating.

11. A cable according to claim 10 wherein the coating material comprises polyvinyl chloride and the jacket is formed from a polyvinyl chloride based compound.

12. A method of making a telecommunications cable devoid of a metal sheath and having a core including a plurality of individually insulated conductors, a surrounding jacket and a plurality of substantially inextensible elongate tensile members embedded in the jacket and extending longitudinally of the cable, the method comprising drawing the elongate tensile members and the core, in desired respective positions, along a passline through a jackt forming station and extruding molten polymeric material around the core and the tensile members to form the jacket while resisting movement of the tensile members in at least one position upstream from the jacket forming station to apply a tensile load to each of the members which is greater than any tensile load applied to the core, and allowing the jacket to cool and harden while retaining a greater tensile load on each of the tensile members than on the core.

13. A method according to claim 12 wherein the tensile load which is applied to each of the tensile members is approximately 2 lbs.

14. A method according to claim 12 comprising embedding rovings of tensile fibers in the jacket as the tensile members.

15. A method according to claim 12 comprising wrapping a core wrap around the core and extruding the jacket around the core wrap, the core wrap having a surface treatment to cause it to adhere to the jacket.

16. A method of making a telecommunications cable devoid of a metal sheath and having a core including a plurality of individually insulated conductors, a surrounding jacket and a plurality of substantially inextensible elongate tensile members embedded in the jacket and extending longitudinally of the cable, the method comprising providing the elongate tensile members with a coating and drawing the coated tensile members and the core, in desired respective positions, along a passline through a jacket forming station and extruding molten polymeric material around the core and the tensile members to form a jacket adhering to the coating while resisting movement of the tensile members in at least one position upstream from the jacket forming station to apply a tensile load to each of the members which is greater than any tensile load applied to the core, and allowing the jacket to cool and harden while retaining a greater tensile load on each of the tensile members than on the core.

* * * * *